United States Patent [19]

Hoffmann et al.

[11] 4,181,191

[45] Jan. 1, 1980

[54] PNEUMATIC SYSTEM FOR A CENTRAL LOCKING SYSTEM FOR MOTOR VEHICLES ACTUATED BY A FLOWING MEDIUM

[75] Inventors: Rüdiger Hoffmann, Sindelfingen; Dieter Feichtiger, Aidlingen; Theodor Reinhard, Böblingen; Ernst Haug, Sindelfingen; Bernhard Schulze, Ehningen; Emil Bleibtreu, Sindelfingen, all of Fed. Rep. of Germany

[73] Assignee: Daimler-Benz Aktiengesellschaft, Fed. Rep. of Germany

[21] Appl. No.: 893,529

[22] Filed: Apr. 4, 1978

[30] Foreign Application Priority Data

Apr. 5, 1977 [DE] Fed. Rep. of Germany ..... 2715136

[51] Int. Cl.[2] ..... E05B 65/38

[52] U.S. Cl. ..... 180/289; 70/264

[58] Field of Search ..... 180/103 R, 111, 112, 180/113, 114; 70/264

[56] References Cited

U.S. PATENT DOCUMENTS

| | | | |
|---|---|---|---|
| 2,882,987 | 4/1959 | McDougal, Sr. et al. | 180/114 |
| 3,096,112 | 7/1963 | Johnstone | 180/112 X |
| 3,111,184 | 11/1963 | Oishei | 180/113 |
| 3,141,517 | 7/1964 | Detloff et al. | 180/112 |

FOREIGN PATENT DOCUMENTS

| | | | |
|---|---|---|---|
| 1128323 | 4/1962 | Fed. Rep. of Germany | 180/281 |

*Primary Examiner*—Joseph F. Peters, Jr.
*Assistant Examiner*—Michael Mar
*Attorney, Agent, or Firm*—Craig and Antonelli

[57] ABSTRACT

A pneumatic system for a central locking installation of motor vehicles with lines that conduct pressures to pneumatic elements, of which one each is coordinated to the parts to be locked, such as doors, tank lid, rear lid and/or front hood and the like, whereby key actuation of the locking mechanism at a vehicle door opens, respectively, closes the associated part(s); the pneumatic elements are constructed as single-chamber elements, to which excess pressure and vacuum are alternately fed through the same line; the excess pressure and vacuum are produced by a pump driven by an electric motor that is set into operation by a pulse transmitter engaged during the actuation of the locking mechanism of the driver door, and that is again automatically turned off after the termination of the opening or locking operation.

11 Claims, 2 Drawing Figures

Figure 1:
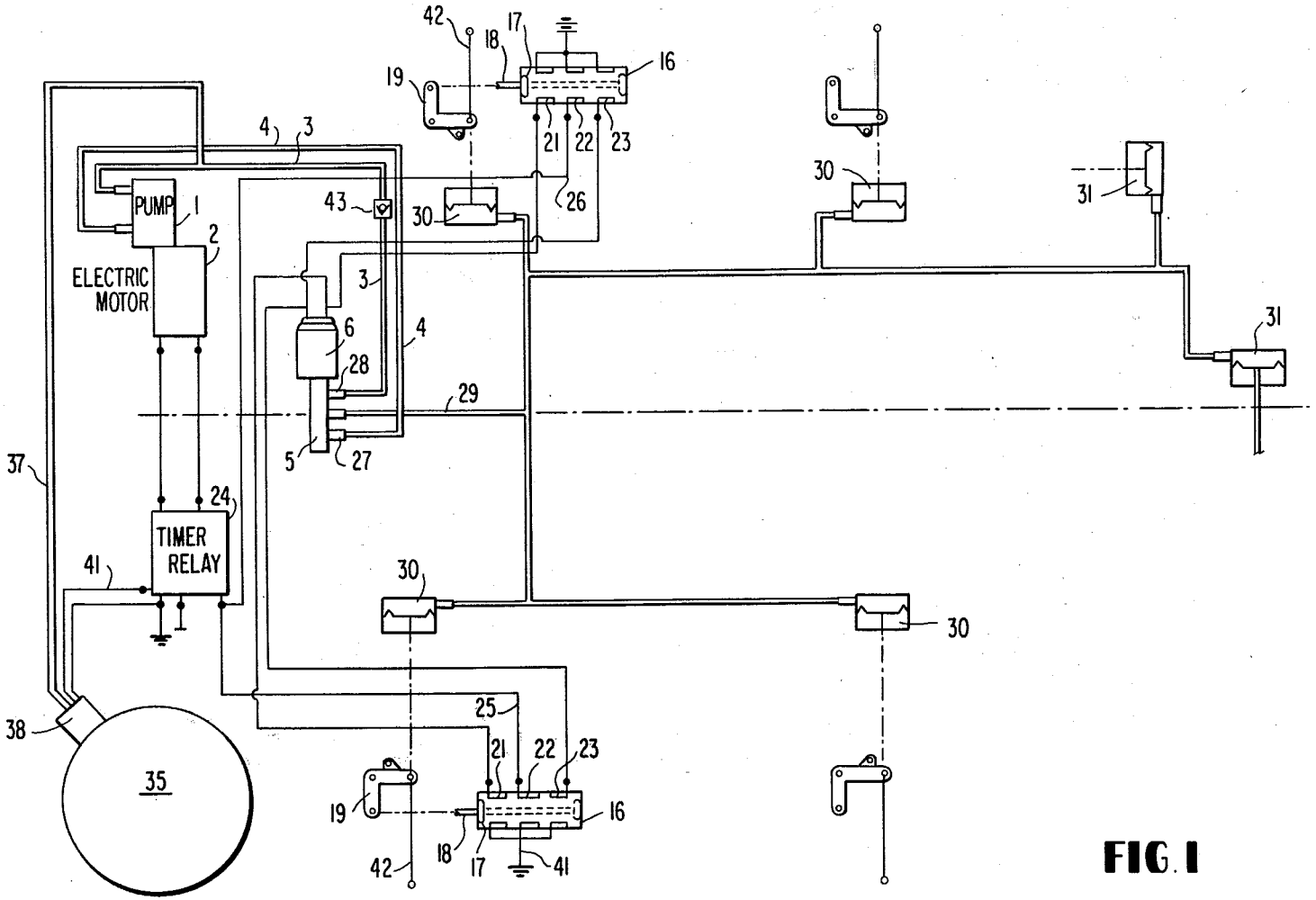

PNEUMATIC SYSTEM FOR A CENTRAL LOCKING SYSTEM FOR MOTOR VEHICLES ACTUATED BY A FLOWING MEDIUM

The present invention relates to a pneumatic system for a central locking installation actuated by a flowing (fluid) medium for motor vehicles with lines, which conduct pressures to pneumatic elements, of which one each is coordinated to the parts to be locked such as doors, tank lid, rear and/or front lid and the like, which during the key actuation of the locking mechanism at least at one of the two driver (front) doors opens, respectively, closes the associated part.

Vacuum was used with the heretofore known central locking systems operating with a fluid medium which produced by the engine and picked off from the suction pipe was fed to a storage or reservoir tank from where the vacuum was fed by way of two lines each to pneumatic elements operating with two chambers. With these prior pneumatic elements provided each with two chambers, one chamber remained actuated with vacuum. This system, in addition to the respective two lines, also required a high degree in fluid-tightness of the switches, of the pneumatic elements, of the line connections and of the vacuum reservoir installations as well as at the valves. Nonetheless, it was possible in these prior art systems that after a longer period of time during which the vehicle was parked, the vacuum in the vacuum tank collapsed so that the vehicle could then still be opened only mechanically. In order to eliminate this, expensive seal and tightness tests had to be provided. Additionally, it was also possible that gasoline vapors were sucked-in with the suction air out of the engine suction space, which could reach the air pressure system. Consequently, the air pressure system had to be made of gasoline-resistant materials. All of these disadvantages and the expenditures connected therewith are to be avoided by the present invention.

It is therefore the aim of the present invention to provide a more simple air pressure system, which can be manufactured more simply, whose assembly and installation is simpler and which is continuously ready for operation over a longer period of time without the sealing safety precautions.

The underlying problems are solved according to the present invention in that the pneumatic elements serving for the opening and for the locking are constructed as single-chamber elements, to which excess pressure, respectively, vacuum, is alternately fed by way of the same line, which are produced by a pump driven by an electric motor that is set into operation by a pulse transmitter engaged during the actuation of the locking mechanism of the driver door and is again automatically turned off after the termination of the opening or locking operation.

In order that the lines are also correctly switched prior to a pressure production, the pulse transmitter engages the motor by way of a timer relay only after it has established a contact to a solenoid valve which permits entry of excess pressure or vacuum into the lines to the pneumatic elements and as a result thereof, brings about the correct setting for the actuation of the pneumatic elements which then close or open the locks. Such electrically operating pulse transmitters which are actuated by the inserted and rotated key may be provided at each of the driver (front) doors and may establish from there the contact to the solenoid valve which initiates thereby the locking or opening operation in the desired manner so that vacuum or excess pressure is fed to the feed lines.

On the other hand, the pulse transmitter, which engages the pump motor by way of a timer relay, may also be constructed as pneumatic switch which depending on the type of the locking operation, itself permits entry of excess pressure or vacuum into the lines leading to the pneumatic elements and thereby closes or opens the locks or vice versa. With this construction, the solenoid valve can be economized. It is then also not necessary to provide such a pulse pneumatic switch at each door. The use of such a switch at the driver door where the driver is actually seated then suffices whereas the other door coordinated to the co-driver, which includes the usual means for the mechanical opening of this door, may be provided without central locking means.

In order that with a turned-off vehicle the doors cannot be opened in an undesired manner by unauthorized persons by means of the central locking system, provision is made that a check valve is arranged in the pressure lines which prevents that the central locking system can be opened by blowing air into this line.

Even though with the type of construction of the present invention, a reservoir tank is no longer required, the latter may be provided nonetheless in order to possibly connect thereto other loads. A line to a vacuum reservoir tank is then connected to the vacuum line of the pump, which tank is provided with a pressure switch shifted by the timer relay.

Accordingly, it is an object of the present invention to provide a pneumatic system for a central locking installation actuated by a fluid medium for motor vehicles, which avoids by simple means the aforementioned shortcomings and drawbacks encountered in the prior art.

Another object of the present invention resides in a pneumatic system for a central locking installation of motor vehicles actuated by a fluid medium which obviates the need for a high degree of seal of the various parts thereof, such as of the switches, of the line elements, of the valves and the like.

A further object of the present invention resides in a pneumatic system for a central locking installation of motor vehicles which obviates the need for two lines leading to each of the elements of the system, thereby reducing the cost thereof.

Still a further object of the present invention resides in a pneumatic system for central locking installations of motor vehicles which eliminates the possibility that the vehicle can only be opened mechanically after a longer period of standstill.

Still another object of the present invention resides in a pneumatic system for a central locking installation of motor vehicles, which effectively reduces the costs thereof in a significant manner while improving the reliability of operation thereof.

A further object of the present invention resides in a pneumatic system of the type described above which can be manufactured and assembled in a simple manner and which is constantly ready for operation over relatively longer periods of time without special precautions to assure the sealing tightness of the various parts thereof.

A further object of the present invention resides in a pneumatic system for a central locking installation of motor vehicles which also precludes the unauthorized opening of the central locking system, for example, by blowing air into the lines thereof.

Figure 2:
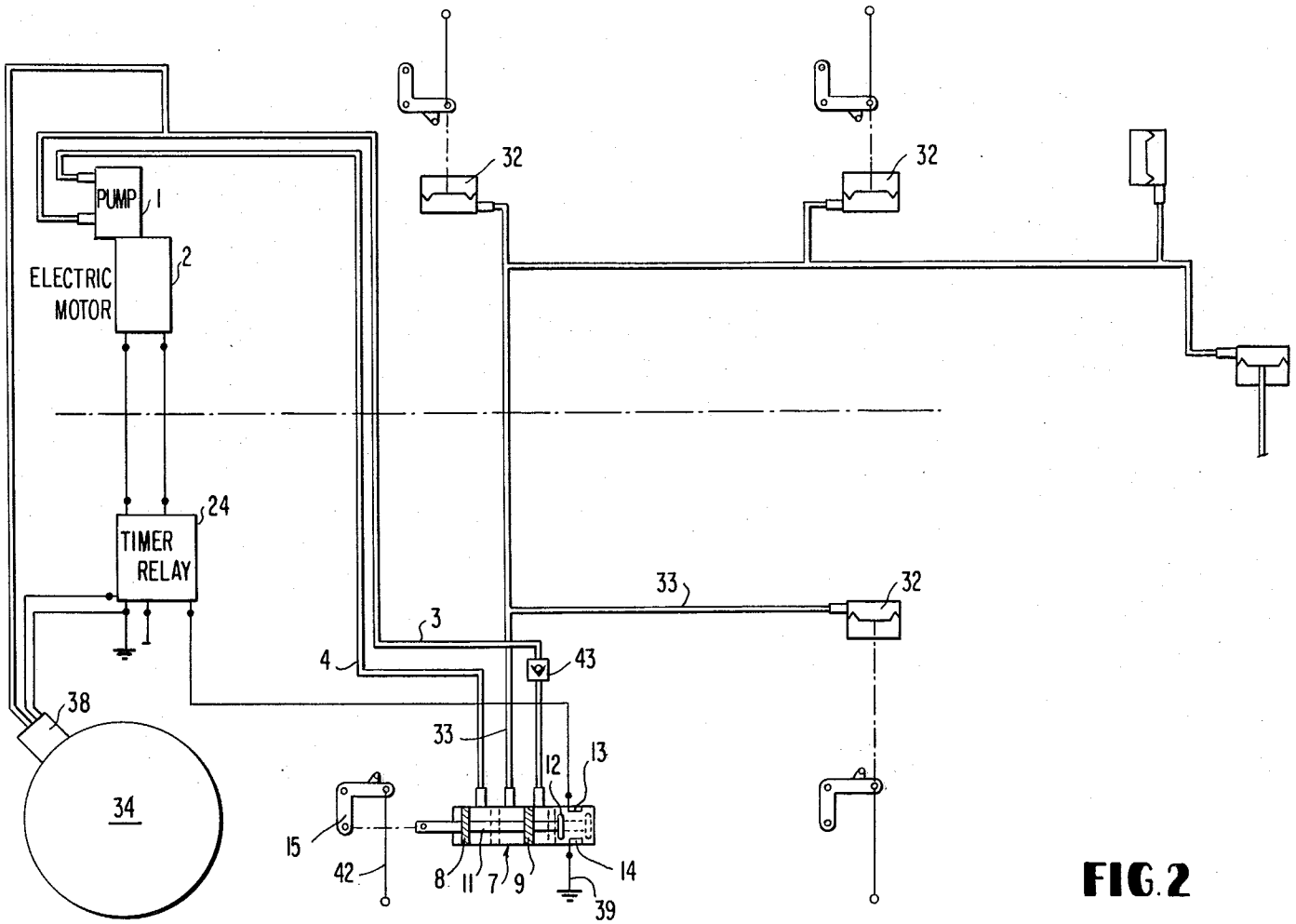

These and other objects, features and advantages of the present invention will become more apparent from the following description when taken in connection with the accompanying drawing which shows, for purposes of illustration only, two embodiments in accordance with the present invention, and wherein:

FIG. 1 is a schematic view of a pulse pneumatic system for a central locking installation of a motor vehicle in accordance with the present invention with a pulse transmitter provided exclusively with electrical contacts; and FIG. 2 is a schematic view of a similar pulse pneumatic system for a central locking installation of motor vehicles according to the present invention with a pulse pneumatic switch which, in addition to electric contacts, is also provided with control members for switching to the different pressures.

Referring now to the drawing wherein like reference numerals are used throughout the two views to designate like parts, the pneumatic system according to the present invention for the central locking installation in motor vehicles operates with air pressure which is produced as excess pressure and as vacuum by an air pump 1 that is driven by an electric motor 2. Lines 3 for the vacuum and lines 4 for the excess pressure start from the pump 1 which in the embodiment according to FIG. 1 extend to a control switch 5 that is actuated by a solenoid valve 6. In the embodiment according to FIG. 2, the lines 3 and 4 for vacuum and excess pressure extend to a pulse pneumatic switch generally designated by reference numeral 7, in which are arranged two pistons 8 and 9 that are mounted on a common piston rod 11 and can be displaced in unison therewith. Additionally, a contact maker 12 is mounted on this piston rod 11, which during actuation of the piston rod 11, closes or opens the contacts 13 and 14.

This pulse pneumatic switch 7 is provided only at the driver door. Its piston rod 11 is mechanically connected with a bell-crank 15, to which are pivotally connected the lock actuation and the mechanical inside actuation. In contrast thereto, in lieu of the pulse pneumatic switch 7, also a pulse transmitter 16 effective only electrically may be used, as is shown in FIG. 1. In this case, two pulse transmitters 16 are provided at the two front doors and are connected electrically in parallel with one another. A contact maker 17 is arranged in the pulse transmitter 16, which is actuated by a piston rod 18 which is operatively connected with a bell-crank 19, at which are again pivotally connected the locking mechanism of the associated door lock as also the mechanical inside locking means.

The pulse transmitter 16 (FIG. 1) includes three contact pairs 21, 22 and 23 which during the movement of the piston rod 18 and of the contact maker 17 are sequentially short-circuited. Two contact pairs 22 of the pulse transmitter 16 are connected by electric lines 25 and 26 with a timer relay 24 of conventional construction which takes care for the engagement of the pump motor 2 when the timer relay 24 receives an electric pulse. The contact pairs 21 and 23 of the pulse transmitter 16 are connected with the solenoid valve 6. Upon the short-circuiting of a respective one of the contact pairs, the solenoid valve 6 switches the control switch 5 coupled therewith from the excess pressure coming from the line 4 to the vacuum coming from the line 3. A further pneumatic line 29 is connected to the control switch 5 between the connections 27 and 28 of the excess pressure line 4 and of the vacuum line 3, which further pneumatic line 29 leads to the individual pneumatic elements 30, 31 that are provided at the doors, respectively at the tank lid and at the rear and/or front hood locking mechanisms. The corresponding pneumatic elements 32 are connected in the case of the embodiment according to FIG. 2 with a pneumatic line 33 which is connected to the pulse pneumatic switch 7 between the excess pressure line 3 and the vacuum line 4.

One vacuum storage tank 34, respectively, 35 may be connected by means of the lines 36, respectively, 37 to the pressure line 3. The pneumatic lines 36 and 37 are connected respectively by way of a pressure switch 38 with a reservoir tank 34, respectively, 35. The pressure switch 38 opens with a sufficiently large vacuum in the lines 36, respectively, 37 when the pump 1 produces a sufficiently large vacuum.

The contact 14 of the pulse pneumatic switch 7 and of a part of the contact pairs 21 to 23 of the pulse transmitter 16, which are connected with each other, are connected by electric lines 39, respectively, 41 with the ground.

Upon actuation of a pulse transmitter 16 by means of the associated key from the outside or by movement of the locking rod 42, the bell crank 19 is pivoted in the case of the embodiment illustrated in FIG. 1 and therewith the piston rod 18 and the contact maker 17 are displaced from the position thereof illustrated in the drawing in full lines on the left side of the pulse transmitter 16 to the right side thereof, where it is illustrated in dash lines. The contact maker 17 thereby passes at first the contact pair 21. By closing the contact pair 21, the solenoid valve 6 had already previously been shifted to excess pressure during the return of the contact maker 17. With a renewed closing of the contacts of the contact pair 21, nothing changes therefore with the energization of the solenoid valve 6. Thereupon, the contact pair 22 is short-circuited so that a pulse is transmitted to the timer relay 24 which causes the motor 2 to start, as a result of which the pump 1 is set into operation for about 5 seconds and excess pressure as well as vacuum are produced thereby. During passage of the contact maker 17 at the contact pair 23, a pulse is transmitted to the solenoid valve 6 which now shifts the control switch 5 so that now vacuum is transmitted into the line 29 and as a result thereof, all doors with the pneumatic element 30 and the tank lid as well as the rear locking mechanism with the pneumatic element 31 are opened.

During the locking of one of the two vehicle doors by means of the key or by depressing the locking rod 42, the contact maker 17 at first passes the contact pair 23, whereby no shifting operation results from the energization of the solenoid valve 6 because the control switch 5 had already been switched to vacuum. Thereupon, the contact pair 22 is again short-circuited so that the timer relay 24 receives a pulse by means of which the motor 2 is set into operation for a period of five seconds. As a result thereof, excess pressure and vacuum are produced in the pump 1. During the further movement of the contact maker 17 toward the left, the latter passes the contact pair 21 and short-circuits the same so that the solenoid valve 6 is again energized and now switches from vacuum to excess pressure. This excess pressure flows into the line 29 and to the pneumatic elements 30 and 31, as a result of which all doors, the tank lid and the rear locking mechanism are locked.

The solenoid valve 6 together with the control switch 5 according to FIG. 1 can be dispensed with by the special construction of the pulse pneumatic switch 7 according to FIG. 2. A position of the piston rod 11 with the pistons 8 and 9 of the pulse pneumatic switch 7 is illustrated in FIG. 2, in which excess pressure had been supplied to the pneumatic line 33 by way of the excess pressure line 4, as a result of which the doors, the tank lid and the rear hood were closed, respectively, locked. If the drive door is now opened by means of the associated key or the locking rod 42 is pulled up from the inside, then the piston rod 11 together with the pistons 8 and 9 moves toward the right and the contact maker 12 passes the contact pair 13, 14 and closes the same. As a result thereof, a pulse is transmitted to the timer relay 24 which thereupon causes the engagement of the motor 2 which sets the pump 1 into rotation that produces the excess pressure and vacuum in the lines 3 and 4. After the shifting operation, the vacuum is now conducted from the vacuum line 3 into the line 33 and as a result thereof, all doors, the tank lid and the rear locking mechanism are opened by actuation of the pneumatic elements 32.

Heretofore, it was possible to open the doors in that a vacuum line was taken off from its connection and excess pressure was blown in thereat. In order to prevent such an undesired opening of the doors, a check valve 43 is installed into the vacuum line 3 and 28, respectively.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A pneumatic system for a central locking installation actuated by a fluid medium for motor vehicles, the pneumatic system comprising a locking mechanism provided at least at one of two doors of the motor vehicle, and line means for conducting pressures to pneumatic elements each of which is associated with a respective part to be locked, the pneumatic elements being operable to selectively open and close the associated part during a key actuation of the locking mechanism, characterized in that a respective pneumatic element serving for the opening and closing of an associated part is constructed as a single chamber means to which excess pressure and vacuum are alternately conducted by way of the same line means, a pump means driven by a motor means is provided for producing said excess pressure and vacuum, a pulse transmitter means is operatively connected with said motor means so as to set said motor means into operation upon an actuation of the locking mechanism of the at least one door, and means are provided for automatically turning off the motor means after termination of an opening and closing operation, said means for automatically turning off the motor means includes a timer means operably connected to the pulse transmitter means and the motor means a solenoid valve means is provided for enabling a selective entry of excess pressure or vacuum into the line means for conducting pressures to the pneumatic elements for closing or opening the respective parts to be locked associated therewith, said timer means establishes a contact with said solenoid valve means so as to cause selective activation thereof.

2. A pneumatic system according to claim 1, characterized in that the motor means is an electric motor and the parts to be locked includes at least the driver door, a tank lid and at least one of rear lid and front hood.

3. A pneumatic system according to claim 1, characterized in that one pulse transmitter means is arranged at each of the two doors for establishing the contact to the solenoid valve means so that the central locking installation is pneumatically actuatable from each of the two doors.

4. A pneumatic system according to claim 1, characterized in that said means for automatically turning off the motor means include a timer means operatively connected to the pulse transmitter means and the motor means, the pulse transmitter means is constructed as pneumatic switch means for enabling a selective entry into the line means conducting pressures to the pneumatic elements of excess pressure or vacuum for thereby closing or opening the respective parts to be locked associated therewith in dependence upon whether the locking mechanism is activated by a key or by operation of a locking rod arranged in the motor vehicle.

5. A pneumatic system according to claim 4, characterized in that vacuum line means and pressure line means are provided between the pump means and the line means conducting pressures to the respective pneumatic elements, for supplying a vacuum and excess pressure to the line means, and in that a check valve means is arranged in the vacuum line means.

6. A pneumatic system for a central locking installation actuated by a fluid medium for motor vehicles, the pneumatic system comprising a locking mechanism provided at least at one of two doors of the motor vehicle, and line means for conducting pressures to pneumatic elements each of which is associated with a respective part to be locked, the pneumatic elements being operable to selectively open and close the associated parts during a key actuation of the locking mechanism, characterized in that a respective pneumatic element serving for the opening and closing of an associated part is constructed as a single chamber means to which excess pressure and vacuum are alternately conducted by way of the same line means, a pump means driven by a motor means is provided for producing said excess pressure and vacuum, a pulse transmitter means is operatively connected with said motor means so as to set said motor means into operation upon an actuation of a locking mechanism of the at least one door, and means into operation upon an actuation of the locking mechanism of the at least one door, and means are provided for automatically turning off the motor means after termination of an opening or closing operation including a timer means operatively connected to pulse transmitter means and the motor means, the pulse transmitter means is constructed as a pneumatic switch means for enabling a selective entry into the line means for conducting pressures to the pneumatic elements of excess pressure or vacuum for closing or opening the respective parts to be locked associated therewith in dependence upon whether the locking mechanism is activated by a key or by operation of a locking rod arranged in the motor vehicle.

7. A pneumatic system according to claim 6, characterized in that vacuum line means and pressure line means are provided between the pump means and the line means conducting pressures to the respective pneumatic elements for supplying a vacuum and excess pressure to the line means, and in that a check valve means is arranged in the vacuum line means.

8. A pneumatic system according to claim 7, characterized in that a further line means is connected to the vacuum line means, said further line means leads to a vacuum reservoir means, and in that pressure switch means operated by the timer means is provided at the vacuum reservoir means.

9. A pneumatic system according to claim 8, characterized in that a solenoid valve means is provided for enabling a selective entry of excess pressure or vacuum into the line means for conducting pressures to the respective pneumatic elements for closing and opening the respective parts to be locked associated therewith, said timer means establishes a contact with said solenoid valve means to cause selective activation thereof.

10. A pneumatic system according to claim 9, characterized in that one pulse transmitter means is arranged at each of the two doors for establishing the contact to the solenoid valve means so that the central locking installation is pneumatically actuatable from each of the two doors.

11. A pneumatic system for a central locking installation actuated by a fluid medium for motor vehicles, the pneumatic system comprising a locking mechanism provided at least at one of two doors of the motor vehicle, and line means for conducting pressures to pneumatic elements each of which is associated with a respective part to be locked, the pneumatic elements being operable to selectively open and close the associated part during a key actuation of the locking mechanism, characterized in that a respective pneumatic element serving for the opening and closing of an associated part is constructed as a single chamber means to which excess pressure and vacuum are alternately conducted by way of the same line means, a pump means driven by a motor means is provided for producing said excess pressure and vacuum, a pulse transmitter means is operatively connected with said motor means so as to set said motor means into operation upon an actuation of the locking mechanism of the at least one door, and means are provided for automatically turning of the motor means after a termination of an opening and closing operation, the pump means includes a vacuum line means for supplying a vacuum to the line means conducting pressures to the respective pneumatic elements, a further line means is connected to the vacuum line means, said further line means leads to a vacuum reservoir means, and in that a pressure switch means operated by the timer means is provided at the vacuum reservoir means.

* * * * *